US006722329B2

(12) United States Patent
Pierik et al.

(10) Patent No.: US 6,722,329 B2
(45) Date of Patent: Apr. 20, 2004

(54) LOCKING PIN MECHANISM FOR A CAMSHAFT PHASER

(75) Inventors: Ronald J. Pierik, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/421,260

(22) Filed: Apr. 23, 2003

(65) Prior Publication Data

US 2003/0217717 A1 Nov. 27, 2003

Related U.S. Application Data

(60) Provisional application No. 60/382,237, filed on May 21, 2002.

(51) Int. Cl.[7] ..... F01L 1/34

(52) U.S. Cl. ..... 123/90.17; 123/90.12; 123/90.15; 92/5 L; 92/5 R

(58) Field of Search ..... 123/90.17, 90.12, 123/90.15, 90.16, 90.31; 92/5 L, 5 R; 464/2; 324/207.11, 207.22, 207.24, 207.26; 73/866.5; 137/553, 554

(56) References Cited

U.S. PATENT DOCUMENTS

| | | | | | |
|---|---|---|---|---|---|
| 4,909,195 | A | * | 3/1990 | Hasebe et al. | 123/90.16 |
| 5,167,206 | A | * | 12/1992 | Suga | 123/90.17 |
| 5,455,509 | A | * | 10/1995 | Semura et al. | 324/207.24 |
| 6,244,230 | B1 | * | 6/2001 | Mikame | 123/90.17 |
| 6,330,870 | B1 | * | 12/2001 | Inoue et al. | 123/90.17 |

* cited by examiner

*Primary Examiner*—Thomas Denion
*Assistant Examiner*—Kyle Riddle
(74) *Attorney, Agent, or Firm*—Patrick M. Griffin

(57) ABSTRACT

A locking pin mechanism disposed in a bore in a cam phaser rotor vane for controllably engaging the camshaft sprocket to rotationally lock together the rotor and stator of a vane-type camshaft phaser. A lock pin sleeve in the bore extends from the vane through a slot in the cover plate. Disposed within the sleeve is a slidable lock pin having a locking head for engaging the sprocket and a tail portion extending through the outer end of the sleeve. The tail portion of the lock pin may be manually retracted by an operator while the phaser is being installed or removed from the engine, thus preventing damage from high torque exerted via the phaser attachment bolt in bolting the phaser to the engine.

11 Claims, 7 Drawing Sheets

LOCKING PIN MECHANISM FOR A CAMSHAFT PHASER

This application claims priority from Provisional U.S. Patent Application Ser. No. 60/382,237, filed May 21, 2002.

TECHNICAL FIELD

The present invention relates to a camshaft phaser for controlling the phase relationship between the crankshaft and a camshaft of an internal combustion engine; more particularly, to a vane-type phaser having a locking mechanism for selectively locking the rotor to the stator; and most particularly, to a locking mechanism for a vane-type phaser wherein a locking pin extends beyond the rotor chamber such that the pin may be manually withdrawn from locking engagement by an operator during mounting of the phaser to an engine to avoid torque damage to the locking pin mechanism.

BACKGROUND OF THE INVENTION

Camshaft phasers for internal combustion engines are well known. Typically, a camshaft phaser is disposed on the front of an engine and includes an oil control valve for controlling oil flow into and out of the phaser. The valve receives pressurized oil from an oil gallery in the engine block and selectively distributes oil to timing advance and retard chambers within the phaser to controllably vary the phase relationship between the engine's camshaft and crankshaft. In a vane-type phaser, the chambers are formed between inwardly-extending lobes of a generally cylindrical stator and outwardly-extending vanes of a rotor concentrically disposed within the stator.

At various times during the operation of an engine and its associated phaser, it is desirable to rotationally lock the rotor to the stator. For this purpose, a prior art phaser may include a locking pin mechanism in a rotor vane. The mechanism typically includes a sleeve disposed in a bore in the vane and a spring-biased locking pin disposed in a well in the sleeve. The pin is biased to lock into a corresponding well in the sprocket to which the stator is mounted whenever the pin and sprocket well are rotationally aligned. The sprocket well communicates hydraulically with an oil pressure source to automatically force the pin from the sprocket well when certain engine operating conditions are met.

A problem can arise during mounting or removal of the assembled phaser to an engine camshaft. The locking bolt bears on the rotor and hence can exert torque on the rotor as the bolt is being tightened. If the pin is engaged at that time, the pin may be damaged by torque from the rotor. In the prior art, it is generally not possible to ensure that the pin is not engaged as the bolt is tightened.

Another problem encountered in the prior art is the inability to easily confirm the position of the locking pin relative to the sprocket well when the engine is operating.

What is needed is a means for assuredly unlocking the locking pin from the sprocket well during mounting or removal of a phaser to an engine to prevent torque damage to the locking pin mechanism.

What is also needed is a means for detecting the position of the locking pin while the engine is operating.

It is a principal object of the present invention to prevent damage to a locking pin mechanism during mounting or removal of a camshaft phaser to an engine.

It is a further object of the present invention to provide a means for determining the position of the locking pin during engine operation.

SUMMARY OF THE INVENTION

Briefly described, a locking pin mechanism in accordance with the invention is disposed in a bore in rotor vane for controllably engaging a well in the camshaft sprocket to rotationally lock the rotor and stator together. The mechanism comprises a lock pin sleeve disposed in the bore and extending from the vane through an arcuate slot in the inner cover plate. The sleeve terminates in an enlarged head outside the inner cover plate. Preferably, the slot includes a portion wide enough to permit passage of the head through the slot during assembly of the phaser. The slot extends through a central arc at least equal to the actuation arc of the rotor within the stator, preferably about 30°. Disposed within the sleeve is a slidable lock pin having a locking head for engaging the sprocket well and a tail portion extending through the sleeve head. A compression spring within the sleeve urges the pin into lock relationship with the sprocket well whenever they are rotationally aligned. A groove in the sprocket connects the well with an oil source in the assembled phaser such that oil pressure overcomes the spring to retract the pin, unlocking the rotor from the stator.

The tail portion of the lock pin extends beyond the cover plate and the sleeve head, permitting the lock pin to be manually retracted by an operator while the phaser is being installed or removed from the engine, thus preventing damage from high torque exerted via the phaser attachment bolt in bolting the phaser to or removal from the engine. A sensing device, such as a Hall Effect sensor, placed proximate the tail portion of the locking pin, can be used to detect the position of the tail portion, and therefore the relative position of the locking head and the sprocket well while the engine is running.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
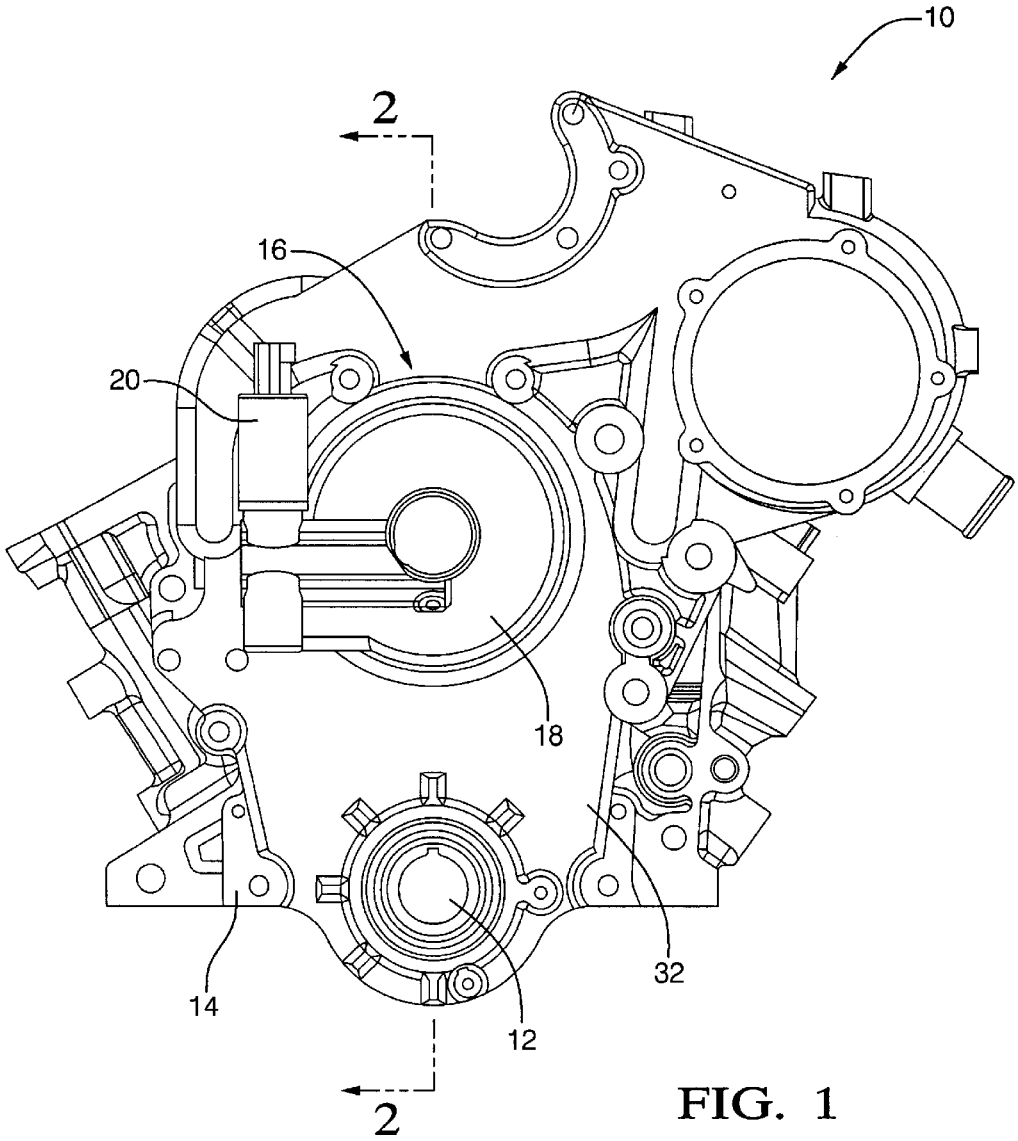
FIG. 1 is a front elevational view of a partially assembled internal combustion engine, showing location of a camshaft phaser in accordance with the invention.

It can be extremely desirable in some applications to have a camshaft phaser which may be coupled to a non-phaser engine with minimum 5 modifications to the engine itself. Phasers in accordance with the present invention meet this requirement and may be of either the spline type or vane type, as will be obvious to one of ordinary skill in the camshaft phaser art. A vane-type phaser is employed in the example below. In general, the only engine change required is a modified front camshaft bearing, ported to provide oil to the phaser from the engine gallery supplying the camshaft and extended to provide a bearing surface for a new camshaft sprocket or pulley which previously was bolted directly to the camshaft but now is coupled to the camshaft via the phaser.

Referring to FIGS. 1 through 5, a partially-assembled internal combustion engine, shown generally as item 10, includes a crankshaft 12 disposed conventionally on block 14. A vane-type camshaft phaser 16 disposed on the front of engine 10 includes an outer cover 18 supporting and cooperating with an oil control valve 20 for controlling oil flow into and out of the phaser. Valve 20 receives pressurized oil from an oil gallery 22 in the engine block, as described below, and selectively distributes oil to timing advance and retard chambers within phaser 16, also as described below, to controllably vary the phase relationship between the engine's camshaft 24 and crankshaft 12 as is known in the prior art.

Camshaft 24 is supported in a camshaft bearing 26 and is hollow at the outer end and threaded conventionally for receiving a phaser attachment bolt 28. Bearing 26 is modified from standard to extend forward of the end of camshaft 24 for rotatably supporting on an outer surface 27 thereof a drive means 30, such as, for example, a camshaft pulley or sprocket connected in known fashion via a timing belt or chain (not shown) to a smaller pulley or sprocket (not shown) mounted on the outer end of crankshaft 12. The two sprockets and timing chain are enclosed by a timing chain cover 32 mounted to engine block 14.

Phaser 16 includes a stator 34 fixedly mounted to sprocket 30 for rotation therewith and an inner cover plate 36 conventionally attached to stator 34 and sprocket 30 via shouldered bolts 31 to define a rotor chamber 35. Stator 34 is formed having a plurality of spaced-apart inwardly-extending lobes 38. Between sprocket 30 and plate 36 within rotor chamber 35 is disposed a rotor 40 having a hub 41 and a plurality of outwardly-extending vanes 42 interspersed between lobes 38 to form a plurality of opposing advance and retard chambers 44, 46 therebetween. This arrangement is well known in the prior art of vane-type camshaft phasers and need not be further elaborated here.

Figure 5:
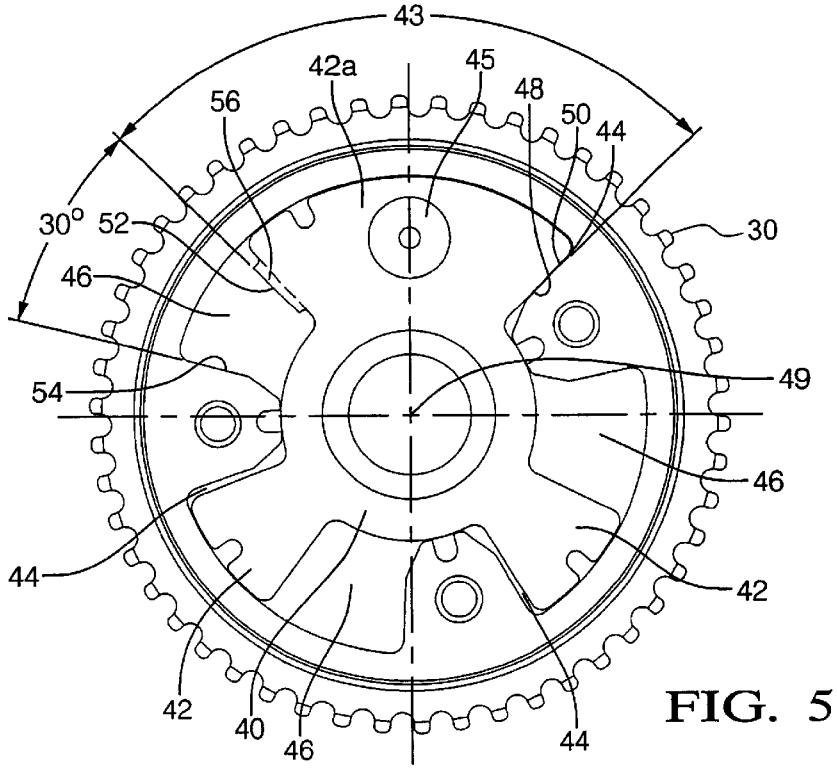
FIG. 5 is a plan view of the camshaft phaser partially assembled, showing the sprocket, stator, and rotor.
Figure 6:
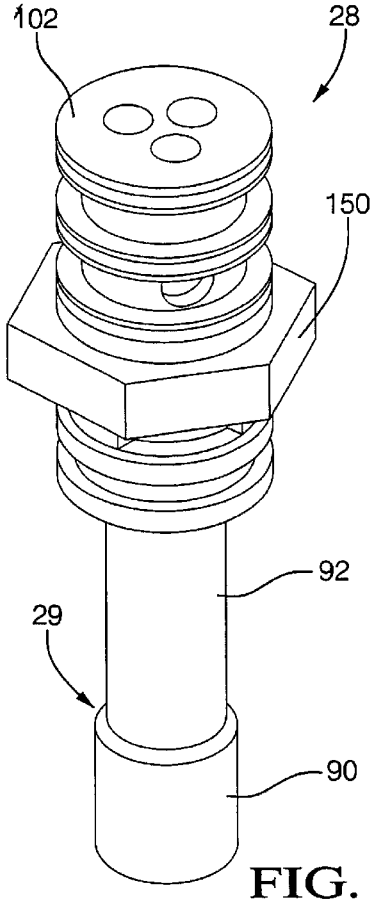
FIG. 6 is an isometric view of a combination attachment bolt and oil conduit element for the camshaft phaser shown in FIG. 3.
Figure 7:
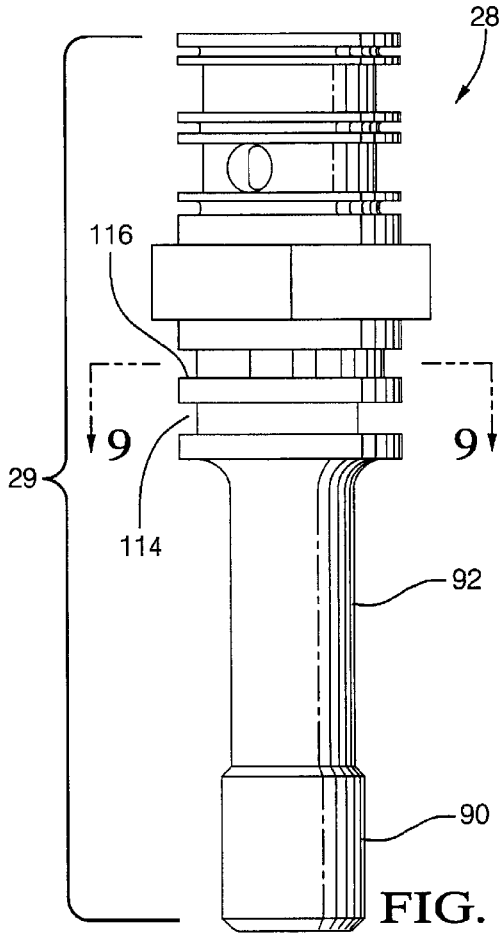
FIG. 7 is an elevational view of the bolt shown in FIGS. 3 and 6.

The preferred embodiment comprises three stator lobes and three rotor vanes. The lobes are arranged asymmetrically about axis 49 as shown in FIG. 5, permitting use of a vane 42*a* extending over a much larger internal angle 43 than the other two vanes 42. Vane 42*a* is thus able to accommodate a locking pin mechanism 45 as described more fully below. Further, a first surface 48 of large vane 42*a* engages a lobe surface 50 at one extreme rotor rotation, as shown in FIG. 5, and a second surface 52 of large vane 42*a* engages a lobe surface 54 at the opposite extreme of rotation. Either or both surfaces 48, 52 may be equipped with hardened wear pads 56.

Only the wide rotor vane 42*a* actually touches the stator lobes; the other vanes and lobes have extra clearance to prevent contact regardless of rotor position. The wide angle vane 42*a* is stronger than the other two narrower vanes 42 and thus is better able to sustain the shock of impact when a vane strikes a lobe in an uncontrolled event such as at engine start-up. The rotor displacement angle, preferably about 30° as shown in FIG. 5, may be limited and calibrated by secondary machining operations on the stator lobe and/or rotor vane contact surfaces.

Referring to FIGS. 2 through 5, locking pin mechanism 45 is disposed in a bore 60 in rotor vane 42*a* for controllably engaging a well 62 in sprocket 30 as desired to rotationally lock the rotor and stator together. Mechanism 45 comprises a lock pin sleeve 64 disposed in bore 60 and extending from vane 42*a* through an arcuate slot 66 in inner cover plate 36. In a cam phaser having an external spring to rotationally bias the rotor in either the retard or advance direction, sleeve 64 may terminate in an enlarged head 67 for retaining an external bias spring 68, as is described more fully below.

Preferably, slot 66 includes a portion 70 wide enough to permit passage of head 67 through the slot during assembly of the phaser. Slot 66 extends through a central arc at least equal to the actuation arc of the rotor within the stator, preferably about 30° as noted above. Vane 42*a* is of sufficient angular width such that the advance and retard chambers adjacent thereto are not exposed to slot 66 even at the extremes of rotor rotation.

Slidingly disposed within an axial bore 71 in sleeve 64 is a lock pin 72 having a locking head portion 74 for engaging well 62 and a tail portion 76 extending through sleeve head 67. Lock pin 72 is single-acting within bore 71. A compression spring 78 within bore 71 urges pin 72 into lock relationship with well 62 whenever they are rotationally aligned. A groove 80 in sprocket 30 (FIG. 3) connects well 62 with a retard chamber 46 in the assembled phaser such that oil pressure applied to the retard chambers overcomes spring 78 to retract pin 72 into bore 71, unlocking the rotor from the stator.

In use, because of the close fit between locking head 74, tail portion 76 and locking pin sleeve 64, trapped oil in axial bore 71 that has leaked past locking head 74 may inhibit free axial movement of locking pin 72. Referring to FIG. 2*a*, an enlarged and more detailed view of locking pin mechanism 45 is shown. Body 73 of locking pin 72 includes longitudinal pressure balance passage 75 extending from tail portion 76 proximate cavity 81 surrounding locking pin mechanism 45, to proximity with a midpoint of pin 72. Radial connector bore 77 is in fluid communication with balance passage 75 and, in use, with sleeve axial bore 71, and the pressures in bore 71 and cavity 81 kept relatively balanced. Thus, oil trapped in axial bore 71 may be vented away from the axial bore. Optionally, in place of passage 75 and bore 77, venting of axial bore 71 may be accomplished via a longitudinal balance groove 65 formed in sleeve 64. Alternately, in place of groove 65 or passage 75, balance passage 75' (shown as dotted lines in FIG. 2*a*), connecting bore 71 with locking pin well 62, may be formed in head 74. Passage 75' serves to keep relatively balanced the pressures in bore 71 and well 62. Since the surface area of head 74 disposed in pin well 62 is greater than the surface area of the opposite surface of head 74 exposed in bore 71, oil pressure received from groove 80 (FIG. 3) will overcome spring 78 to retract pin 72 from well 62.

Figure 4:
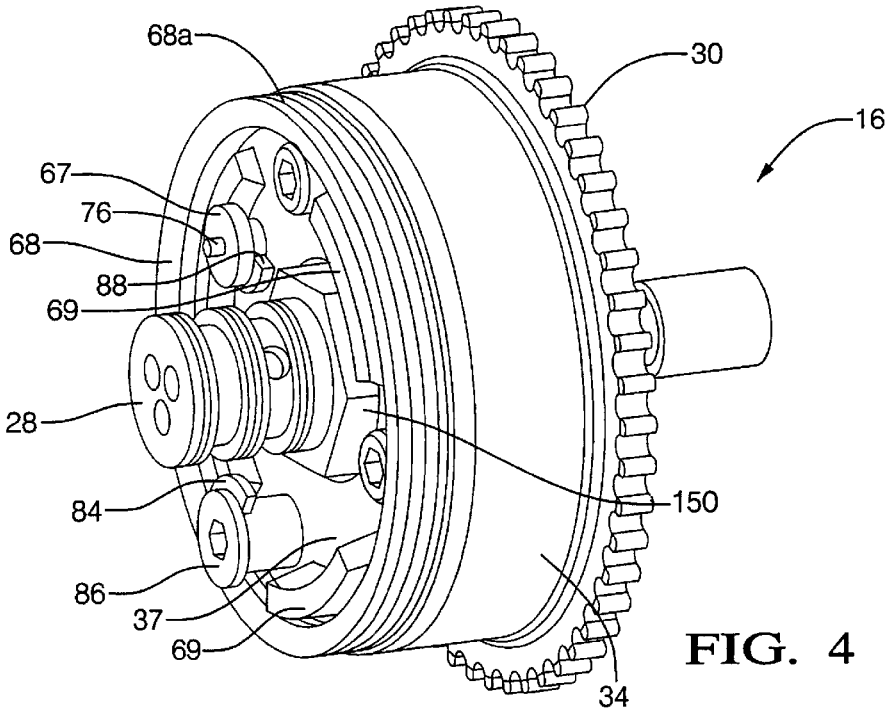
FIG. 4 is an assembled isometric view of the camshaft phaser shown in FIG. 3, the cover and oil control valve being omitted for clarity.

An advantage of the present locking pin mechanism is that tail portion 76 extends beyond cover plate 36 and head 67 (FIG. 4). This feature permits the lock pin to be manually retracted by an operator by grasping tail portion 76 while the phaser is being installed or removed from the engine, thus preventing damage from high torque exerted via cam attachment bolt 28 in bolting the phaser to the engine. A further advantage of the present locking mechanism is that by placing a sensing device such as, for example, a Hall Effect sensor model number A3515LUA, made by Allegro Microsystems of Worcester, Mass. proximate point 79 of outer cover 18, and by securing a permanent magnet proximate end 81 of pin tail portion 76, the magnetic field produced by the magnet can be measured. In turn, using known techniques in the art, by measuring the voltage output of the sensing device which varies according to the magnetic field produced, the relative position of locking head 74 and sprocket well 62 can be determined. This feature permits accurate monitoring and control of pin engagement/disengagement even when the engine is running. It is understood that other means of sensing the axial position of the locking pin in accordance with the invention may be used including, for example, by optical, sonic and inductance measurements.

Figure 2:
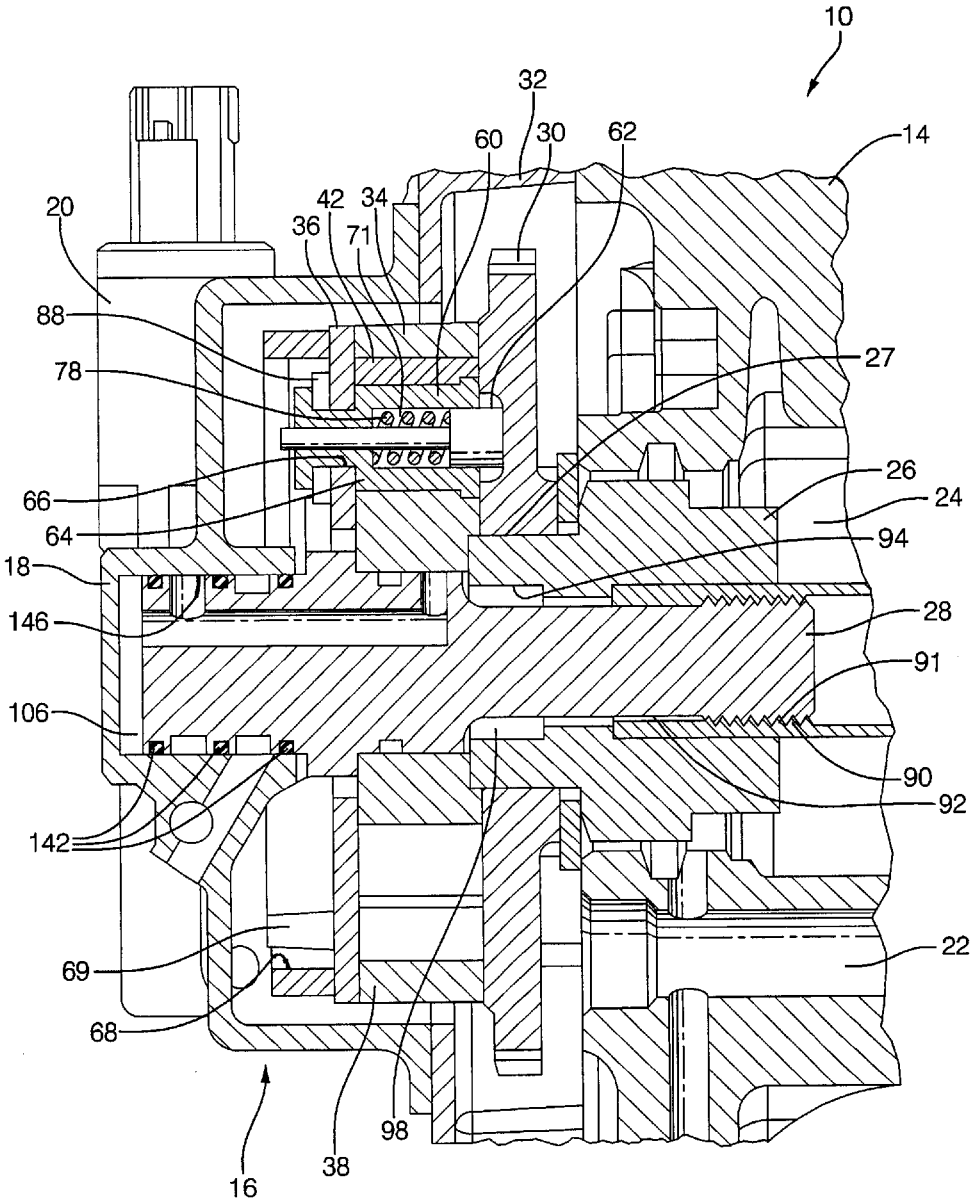
FIG. 2 is a portion of an elevational cross-sectional view through the engine shown in FIG. 1, taken along line 2—2 therein.
Figure 2A:
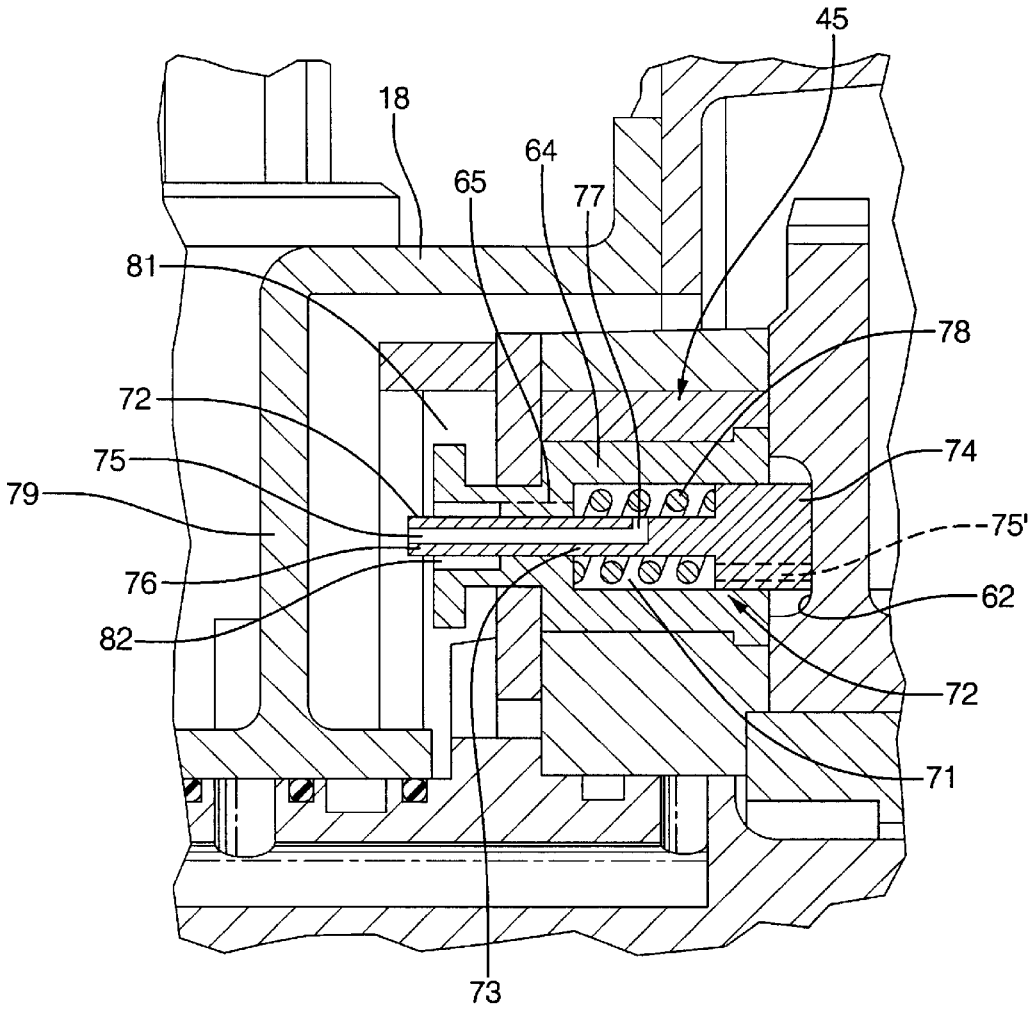
FIG. 2*a* is an enlarged, more detailed view of the locking pin mechanism shown in FIG. 2.
Figure 3:
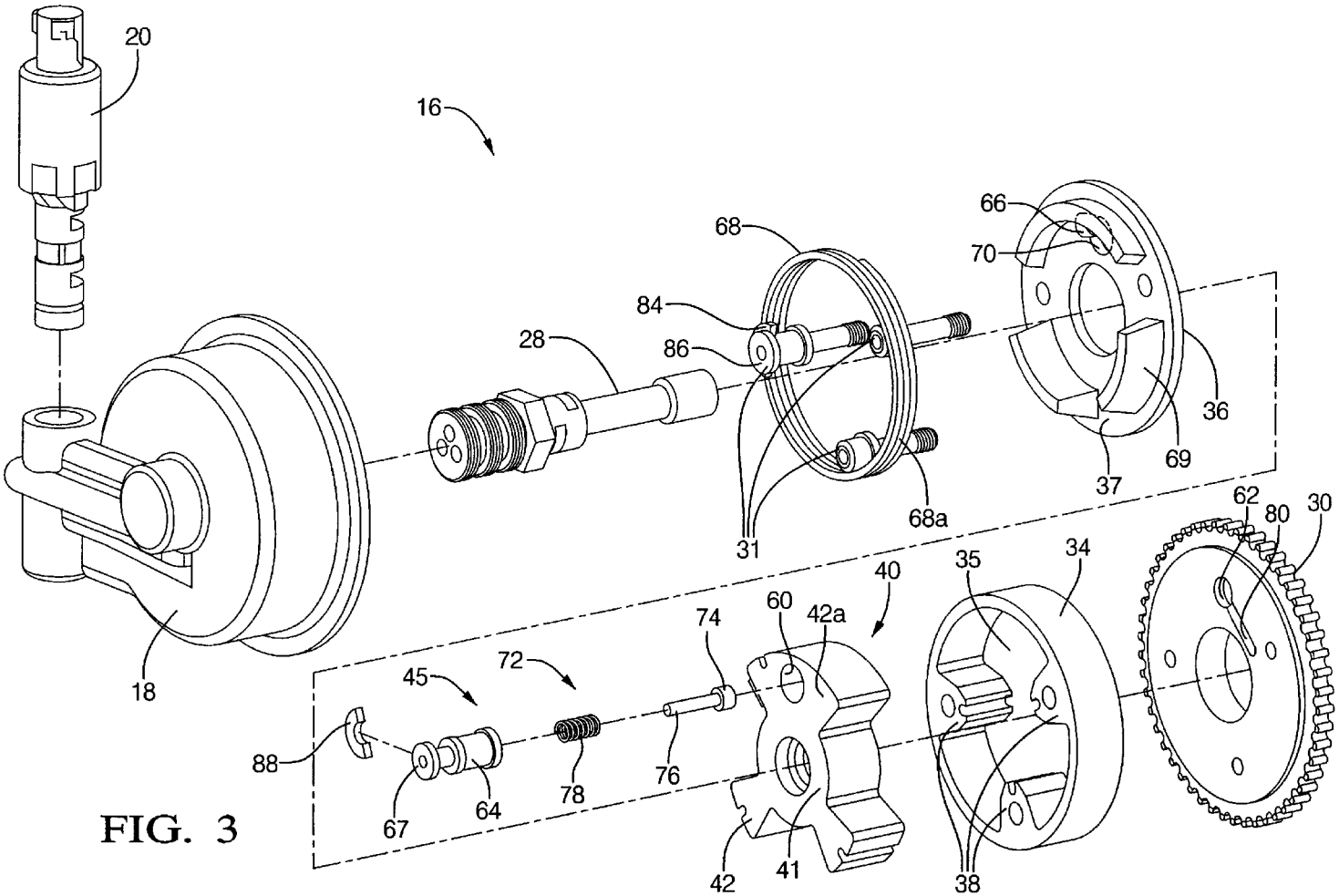
FIG. 3 is an exploded isometric view of a vane-type camshaft phaser in accordance with the invention.

Referring to FIGS. 2 through 4, multiple-turn torsion bias spring 68 is disposed on the outer surface 37 of cover plate 36. A first tang 84 is engaged with a mandrel end 86 of a shouldered bolt 31, and a second tang 88 is engaged with head 67 of locking pin assembly 45. In a cam phaser having a locking pin mechanism as shown in FIG. 2*a*, counter bore 82 proximate head 67 provides additional radial clearance between sleeve 64 and tail portion 76 of pin 72 so that forces placed on the sleeve by the torsion spring do not bind locking pin 72 during operation.

Spring 68 is pre-stressed during phaser assembly such that the locking pin assembly, and hence rotor 40, is biased at its rest state to the fully retarded position shown in FIG. 5. Prior art phasers are known to employ a bias spring within the rotor chamber, but assembly of such an arrangement is difficult and prone to error. The external spring in accordance with the invention is easy to install, and correct installation is easily verified visually.

Referring to FIGS. 2 through 11, phaser attachment bolt 28 serves the added purpose of providing passages for oil to flow from engine gallery 22 via bearing 26 to oil control valve 20 and from control valve 20 to advance and retard chambers 44, 46.

Figure 8:
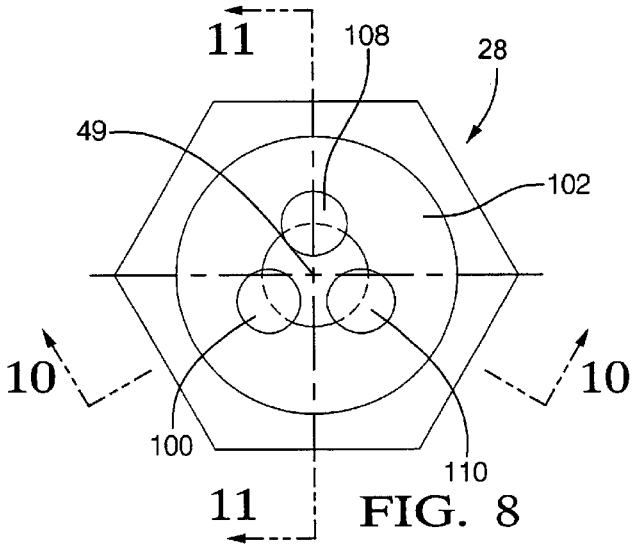
FIG. 8 is a top view of the bolt shown in FIGS. 3 and 6, showing the relationship of various oil passages therein.
Figure 9:
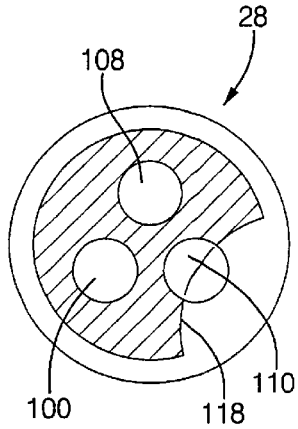
FIG. 9 is a cross-sectional view taken along line 9—9 in FIG. 7, showing access to one of the oil passages.
Figure 10:
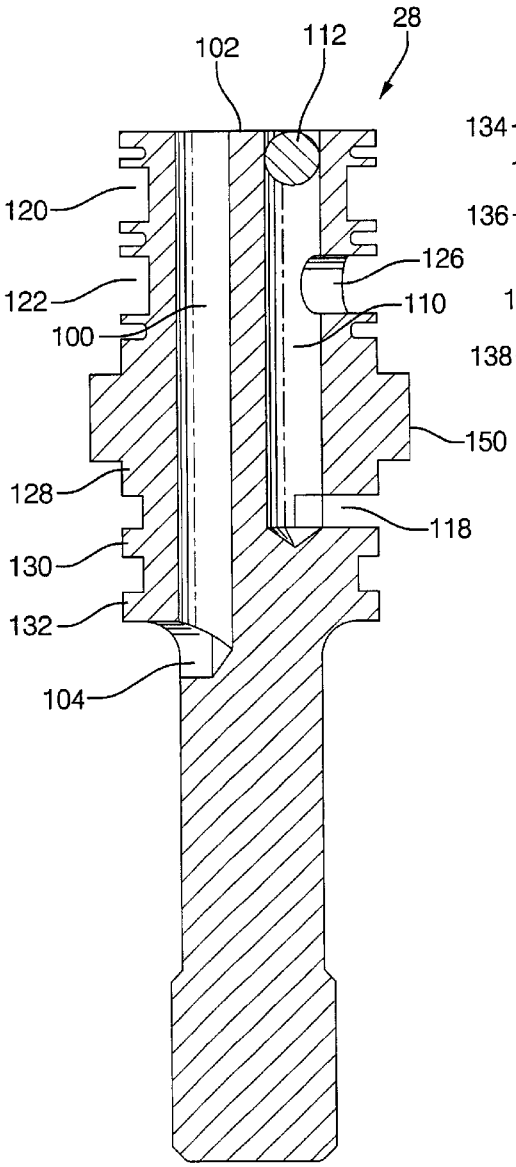
FIG. 10 is a broken cross-sectional view of the bolt taken along line 10—10 in FIG. 8.
Figure 11:
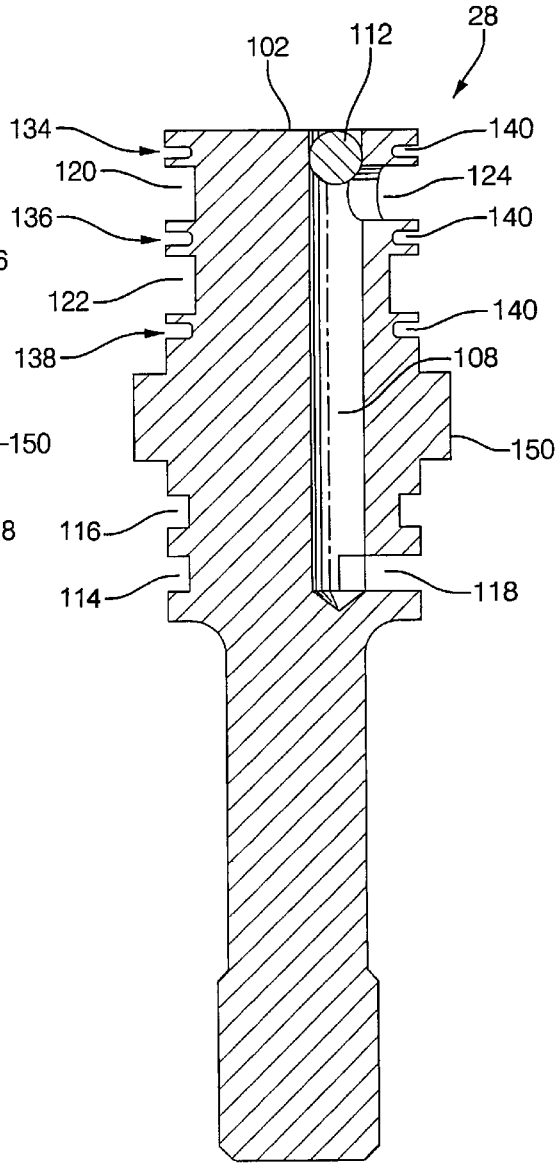
FIG. 11 is a cross-sectional view of the bolt taken along line 11—11 in FIG. 8.

Bolt 28 has a bolt body 29 having a threaded portion 90 for engaging threaded end 91 of camshaft 24 as described above and a necked portion 92 cooperative with bore 94 in bearing 26 to form a first intermediate oil reservoir 98 in communication with gallery 22 via a passage (not shown) through bearing 26. A first longitudinal passage 100 in bolt 28 is formed as by drilling from bolt outer end 102 and extends internally to proximity with necked portion 92. An opening 104 connects passage 100 with reservoir 98. Oil is thus admitted via elements 104, 100, 102 to a second intermediate reservoir 106 formed between outer cover 18 and bolt outer end 102 from whence oil is supplied to control valve 20 via a passage (not shown) formed in outer cover 18. In a currently preferred embodiment, a check valve is disposed in the oil supply passage leading to the oil control valve to enhance the overall phaser system stiffness and response rate. Second and third longitudinal passages 108, 110 in bolt 28 are formed as by drilling from outer end 102, then are plugged as by a press-fit ball 112 or other means to prevent entrance of oil from second intermediate reservoir 106. The three passages preferably are angularly disposed symmetrically about bolt and phaser axis 49 as shown in FIG. 8. Passages 108, 110 are each drilled to a predetermined depth proximate to respective inner annular oil supply grooves 114, 116 formed in the surface of bolt 28 for mating with an advance or retard oil channel (not shown) in the phaser rotor; then, each passage is opened to its respective annular oil supply groove preferably by removal of an arcuate bolt section 118, as shown in FIGS. 9 through 11. Further, outer annular oil supply grooves mate with control passages (not shown) in the cam cover 18. Each longitudinal passage 108, 110 is opened to its respective outer annular oil supply groove 120, 122 by drilling radial connecting bores 124, 126, respectively.

Lands 128, 130, 132 prevent leakage from inner grooves 114, 116 by being machined to have a close fit within the rotor bore. Because in operation of the phaser the bolt turns with the rotor, no special seals are required. However, because the bolt rotates within cover 18, special seals are necessary for outer grooves 120, 122. Preferably, outer lands 134, 136, 138 each comprise twin lands separated by a narrow annular groove 140, each groove being provided with a metal seal ring 142 which is compressed radially into the cover bore 146 and thus is fixed with the cover and does not turn with the bolt.

Bolt 28 is further provided with means for installing the bolt into the camshaft, preferably a wrenching feature. For example, a hexagonal socket (not shown) may be formed in end surface 102 or preferably an external hexagonal feature 150 is formed into the middle region of bolt 28, which feature may be easily wrenched during phaser assembly by an appropriately deep socket wrench.

Thus, when the phaser is fully assembled and installed onto an engine, oil is provided from oil gallery 22 to control valve 20 via first passage 100 and from valve 20 to advance and retard chambers in the phaser via second and third passages 108, 110. No modification is required of the engine block or camshaft in order to fit the present phaser to an engine.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A locking pin mechanism for a vane-type camshaft phaser having a rotor disposed within a rotor chamber formed by a stator, a drive means, and a cover plate, comprising:

a) a first bore in said rotor; and b) a locking pin slidingly disposed in said first bore and having a tail portion extending beyond said bore and said rotor chamber through an opening in said cover plate.

2. A mechanism in accordance with claim 1 wherein said drive means is a sprocket.

3. A mechanism in accordance with claim 1 wherein said drive means includes locking pin receiving means and wherein said locking pin includes a head portion for entering said receiving means to lock said rotor rotationally to said stator, said stator being fixed to said drive means.

4. A mechanism in accordance with claim 3 wherein said locking pin extending from said first bore may be manually grasped and retracted from said locking pin receiving means.

5. A mechanism in accordance with claim 1 further comprising a compression spring disposed within said first bore for urging said locking pin toward said drive means.

6. A mechanism in accordance with claim 1 wherein said opening is an arcuate slot formed in said cover plate.

7. A mechanism in accordance with claim 6 wherein said arcuate slot subtends a central angle equal to the maximum rotational angle of said rotor within said stator.

8. A mechanism in accordance with claim 1 wherein said locking pin further includes a balance passage.

9. A mechanism in accordance with claim 1 wherein said first bore further includes a balance groove.

10. A camshaft phaser for an internal combustion engine, the phaser having a rotor disposed within a rotor chamber formed by a stator, a drive means, and a cover plate, the phaser comprising a locking pin mechanism including a first bore in said rotor, and a locking pin slidingly disposed in said first bore and having a tail portion extending beyond said first bore and said rotor chamber through an opening in said cover plate.

11. A method of measuring the position of a cam phaser locking pin having a tail portion extending from the cam phaser comprising the steps of:

affixing a sensing means for sensing the proximate axial position of said tail portion; and measuring an output of the sensing means.

* * * * *